US005498826A

United States Patent [19]

Dummersdorf et al.

[11] Patent Number: 5,498,826

[45] Date of Patent: Mar. 12, 1996

[54] PLASMATRON WITH STEAM AS THE PLASMA GAS AND PROCESS FOR STABLE OPERATION OF THE PLASMATRON

[75] Inventors: Hans-Ulrich Dummersdorf, Leverkusen; Dietrich Hebecker, Leipzig; Dirk von Lengerken, Halle; Carsten Winter, deceased, late of Grimma; Walter Winter, heir; Renate Winter, heir, both of Furstenwalde, all of Germany

[73] Assignee: Maschinen- und Anlagenbau Grimma GmbH (MAG), Grimma, Germany

[21] Appl. No.: 323,590

[22] PCT Filed: Feb. 26, 1991

[86] PCT No.: PCT/EP91/00348

§ 371 Date: Mar. 1, 1993

§ 102(e) Date: Mar. 1, 1993

[87] PCT Pub. No.: WO91/13532

PCT Pub. Date: Sept. 5, 1991

Related U.S. Application Data

[63] Continuation of Ser. No. 920,475, Aug. 19, 1992, abandoned.

[30] Foreign Application Priority Data

Feb. 26, 1990 [DD] German Dem. Rep. ..... 338 1454

[51] Int. Cl.[6] ..... A62D 3/00

[52] U.S. Cl. ..... 588/210; 588/205; 588/212; 588/227; 204/169; 422/186.04; 422/186.22

[58] Field of Search ..... 204/169; 588/205, 588/210, 212, 227; 422/186.04, 186.22

[56] References Cited

U.S. PATENT DOCUMENTS

| | | | |
|---|---|---|---|
| 3,345,280 | 10/1967 | Berghaus | 204/164 |
| 4,438,706 | 3/1984 | Boday et al. | 110/238 |
| 4,509,434 | 4/1985 | Boday et al. | 110/238 |
| 4,582,004 | 4/1986 | Fey et al. | 588/210 |
| 5,026,464 | 6/1991 | Mizuno et al. | 204/164 |
| 5,108,718 | 4/1992 | Dummersdorf et al. | 422/186.23 |

FOREIGN PATENT DOCUMENTS

| | | |
|---|---|---|
| 0182560 | 5/1986 | European Pat. Off. . |
| 0354731 | 2/1990 | European Pat. Off. . |
| 0215325 | 11/1984 | Germany . |
| 0218984 | 2/1985 | Germany . |
| 3330750 | 3/1985 | Germany . |
| 3605715 | 9/1986 | Germany . |
| 3922383 | 2/1990 | Germany . |
| 2131116 | 5/1990 | Japan . |
| 390172 | 4/1991 | Japan . |
| 3242158 | 10/1991 | Japan . |
| 3295570 | 12/1991 | Japan . |

OTHER PUBLICATIONS

International Search Report.

*Primary Examiner*—John Niebling
*Assistant Examiner*—C. Delacroix-Muirheid
*Attorney, Agent, or Firm*—Birch, Steawrt, Kolasch & Birch

[57] ABSTRACT

The present invention refers to a plasmatron as well as to a process for stable operation of plasmatrons with steam as the plasma gas, in the case of which the operational fluctuations which are typical of steam plasmas as well as the increased degree of electrode erosion are to be avoided. In accordance with the present invention, this is achieved on the basis of a limitation of electrode cooling by using hot water as a coolant having a temperature of at least 80° C. If necessary, it is possible to use, on the one hand, hot water cooling and to exclude, on the other hand, a condensation of the steam on the electrodes by admixing a gas which will lower the condensation temperature of the steam.

7 Claims, No Drawings

PLASMATRON WITH STEAM AS THE PLASMA GAS AND PROCESS FOR STABLE OPERATION OF THE PLASMATRON

This application is a continuation of application Ser. No. 07/920,475 filed on Aug. 19, 1992, now abandoned.

DESCRIPTION

The present invention refers to plasmatrons which are operated with steam as the plasma gas as well as to a process for stable operation of such plasmatrons.

Plasmatrons, which are used for chemical conversion, are predominantly operated with a gas, which is chemically inert with respect to the plasmatron materials, as a plasma gas. Plasma pyrolysis processes, for example, use hydrogen as a plasma gas.

In addition, it has already been known to use steam as a plasma gas for various chemical conversions and on various performance levels, e.g. in the case of coal gasification, (East German Patent 215 325, German-Offenlegungsschrift 3 330 750, German-Offenlegungsschrift 3 605 715).

Moreover, it has already been suggested that toxic waste products, in particular waste products containing fluorinated hydrocarbons or chlorinated hydrocarbons, should be annihilated by a chemical reaction in a steam plasma jet.

In connection with examinations concerning chemical processes in specific fields of application of chemical conversion in a hydrogen plasma atmosphere, it turned out that these chemical processes are caused, on the one hand, by the hydrogen ions and, on the other hand, by the oxygen ions of the steam plasma.

Steam plasmas are advantageous insofar as they have a high concentration of chemically reactive, highly excited oxygen and hydrogen species at comparatively low temperatures of approx. 3000° K., which means that they will be particularly suitable for a series of conversion processes. In the case of all plasmatrons, the thermal load is high so that, due to thermal and/or chemical erosion, a service life will result which prevents continuous operation of a plasmatron without intensive cooling. This concerns primarily the electrodes, but also the gas chamber, the plasmatron housing, the connecting pieces and, depending on the respective structural design, also other components. The coolant used for such plasmatrons is normally water having a temperature of approx. 20° C.

In the case of plasmatrons which are operated by making use of steam as a plasma gas, erosion at the parts which are exposed to, or rather which are in contact with the arc is particularly high in comparison with the use of other plasma gases. Hence, this high erosion load affects especially the cathode and the anode. The comparatively high loss of electrode mass will result in a short service life of the electrodes of the plasmatron operated with steam as a plasma gas so that, due to the frequently necessary exchange of electrodes, a continuous operation will practically be impossible.

For the industrial use of steam plasmatrons, another disadvantage is a phenomenon which is characteristic of such plasmatrons, viz. that abrupt operating troubles in the mode of operation of the plasmatron occur in rapid succession. These troubles manifest themselves in fluctuations or interruptions of the steam flow rate, changes in the arc length, strongly fluctuating arc voltage and arc current strength and a strongly fluctuating plasma enthalpy resulting therefrom. This will cause fluctuations in the chemical conversion in the plasma reactor, i.e. it will impair the product quality as well as the efficiency of the plasmatron. Up to now, measures which are usually taken in the case of plasmatrons, viz. reducing the erosion at the electrodes by intensifying the cooling, have normally failed to show any effect, or they at least failed to show a sufficient effect in the case of plasmatrons working with steam as a plasma gas.

Hence, the present invention is based on the task of improving a plasmatron, which is operated with steam as a plasma gas, in such a way that the service life of the plasmatron components subjected to high thermal loads will be lengthened and that a stable operation of the plasmatron with little fluctuations or with no fluctuations at all can be achieved without any essential increase in the operational expenditure. In particular, the differences existing in the case of plasmatrons with steam plasmas in comparison with other gas plasmas with respect to a much higher electrode erosion as well as strong, disadvantageous operating fluctuations are to be eliminated on the basis of the same thermal process conditions and intensive cooling of all parts, especially electrodes, which are subjected to high thermal loads.

The present invention is additionally based on the task of providing a process for stable operation of a plasmatron operated with steam as a plasma gas, which can be used for achieving, on the basis of intensive cooling of all parts subjected to high thermal loads, in particular of the electrodes of the plasmatron, and on the basis of otherwise conventional thermal process conditions, a continuous operation by increasing the service life of plasmatron parts which are subjected to high thermal loads as well as by reducing or avoiding fluctuations of the operational parameters of the plasmatron. The present invention especially aims at eliminating the causes due to which an essentially higher electrode erosion and fluctuations in the operational parameters will occur in the case of plasmatrons using steam as a plasma gas in comparison with plasmatrons using other gas plasmas, without causing, on the other hand, any disadvantageous modifications of the thermal process conditions nor any disavantageous modifications in the cooling area.

The present invention solves the above-mentioned tasks in the case of a plasmatron using steam as a plasma gas and including a cooling means with a coolant for parts, especially the electrodes, subjected to high thermal loads, on the basis of the feature that, by controlling the operational parameters, in particular the temperature of the parts subjected to high thermal loads and/or the condensation temperature of the plasma gas, a condensation of the plasma gas on the parts which are subjected to high thermal loads and which are, consequently, cooled is avoided.

In accordance with a preferred embodiment of the present invention, a plasmatron, which works with a steam plasma as plasma gas and in which the parts, especially the electrodes, subjected to high thermal loads are cooled by using hot water at a temperature of at least approx. 80° C. as a coolant, is used for chemical conversion, in particular for total annihilation of toxic waste products, especially of waste products containing chlorinated or fluorinated hydrocarbons.

In accordance with a further preferred embodiment of the pesent invention, a break-through of toxic pollutants during treatment of said pollutants in the plasmatron can be prevented even more efficiently, when the cooling effected by hot water or by water at an elevated temperature in accordance with the present invention is combined with a reduction of the condensation temperature of the steam plasma.

For this purpose, air is preferably used as a mixing gas, which is mixed with the plasma steam of the steam plasma.

For solving the above task, viz. the task of providing a process for stabilized operation of a plasmatron working with steam as a plasma gas, said process permitting an increase of the electrode service life as well as an essentially fluctuation-free operation in combination with a high efficiency of the desired chemical conversion, the present invention provides a process of such a nature that operational parameters, in particular the temperature of the coolant and/or the composition of the plasma gas, are controlled in such a way that condensation of the plasma gas, which consists, at least essentially, of steam, on the cooled parts of the plasmatron is avoided. Due to its high thermal capacity and heat dissipation capacity, hot water is preferably used as a coolant, the coolant temperature of said hot water being preferably at least 80° C.

A further improvement of the method of reducing condensation problems with respect to the steam plasma at the hot water-cooled parts of the plasmatron, in particular at the anode and cathode thermally acted upon by the arc, according to the present invention is achieved in accordance with an additional preferred embodiment of the process according to the present invention on the basis of the features that cooling of the plasmatron parts which are subjected to high thermal loads, in particular of the electrodes, by means of hot water having a temperature of at least 80° C. is combined with a reduction of the condensation temperature of the plasma gas by admixing a gas having a lower condesation temperature. Preferably, the plasma steam has air admixed thereto after the evaporation stage so as to lower the condensation temperature of the plasma gas mixture, the condensation temperature of the steam plasma gas particle component lying e.g. at 80° C., whereas in the present case an electrode temperature of more than 80° C. is maintained by electrode cooling according to the present invention, which is effected by means of hot water.

Surprisingly enough, it turned out that the highly increased electrode erosion, which is typical of steam plasmas, and the resultant fluctuations in the mode of operation of the plasma reactor, which have hitherto been opposed to a continuous operation of steam plasmatrons, can be eliminated in that, instead of intensifying the cooling of the plasmatron parts, especially of the electrodes, subjected to high thermal loads, exactly the opposite path is taken, viz. the cooling is limited. It turned out that the hitherto existing problems with respect to electrode erosion as well as abrupt operating troubles in the mode of operation which occur in rapid succession, such as fluctuations or interruptions of the steam flow rate, changes in the arc length, strongly fluctuating arc voltage and arc current strength as well as the resultant fluctuating plasma enthalpy are caused by explosive evaporation of steam condensate at the intensively cooled parts (electrodes) under the influence of the arc. Examinations carried out by the inventor and by the applicant showed that this explosive evaporation of water droplets, which have been formed by condensation, accompanied by mechanical tearing out of material and a chemical-physical interaction of the liquid water phase and of the electrode wall under the initiating influence of the arc results in craterlike depressions in the electrode surface, said depressions defining preferred points of attack for future erosions. Moreover, due to the abrupt evaporation of the condensate, the continuous steam flow rate is strongly interfered with or interrupted for a short period of time, whereby the above-described fluctuations and operating troubles of the plasmatron will be caused.

The solution of the tasks underlying the present invention is to be seen in a plasmatron using, at least essentially, steam as a plasma gas and in a process for stable operation of the plasmatron including the measure of limiting the cooling of the plasmatron parts which are subjected to high thermal loads and which are, consequently, cooled by the use of hot water having a temperature of at least approx. 80° C. as a coolant. The limitation of cooling is, in this case, achieved by the sole reduction of the thermal driving potential between the electrode surface, preferably the inner wall of the anode, and the cooling water.

In accordance with an advantageous embodiment of the present invention, a particularly efficient solution is achieved on the basis of a combination of the limitation of cooling in connection with the use of hot water as a coolant and the simultaneous reduction of the condensation temperature of the steam plasma by admixing a gas having a lower condensation temperature than that of steam, the cooling water input temperature being controlled such that the surface temperature of the cathode and of the anode of the plasmatron lies at least close to the plasma gas mixture condensation temperature corresponding to the new steam partial pressure. The additional gas admixed to the steam as a gas reducing the condensation temperature of the steam plasma is preferably air.

Additional preferred embodiments of the plasmatron as well as of the process for operation of said plasmatron in accordance with the present invention are disclosed in the remaining subclaims.

In the following, the invention will be explained in detail on the basis of an embodiment used for annihilating toxic waste products with the aid of a chemical conversion by a treatment in plasmatrons which are operated essentially with steam as a plasma gas.

In accordance with a preferred embodiment of the invention, a plasma plant for annihilating toxic waste products, preferably for a chemical conversion of waste products containing chlorinated or fluorinated hydrocarbons, comprises 10 plasmatrons each having a power of 30 kw with the adequate reactors and the necessary additional units in the conventional manner. The plant is operated with steam supplied at 25 kg/h at a temperature of 300° C. at 0.1 mPa as a plasma gas.

In spite of intensive cooling of the electrodes, substantial fluctuations of the operational and quality parameters in the plasmatron will normally occur in the case of such a plant, and, due to heavy erosion, the plasmatron anode can no longer be used after a comparatively short period of time.

In accordance with a first embodiment of the present invention, the plasmatron is provided with a cooling means, which uses cooling water as a coolant for cooling the plasmatron parts subjected to high thermal loads, especially the anode and the cathode.

In order to avoid condensation phenomena of the steam plasma on the cooled electrodes, especially on the anode, the cooling water input temperature at the anode and at the cathode is increased to preferably 80° C. by reducing the cooling effect in the coolant circuits of the plant so that the plasmatron parts subjected to high thermal loads are cooled by hot water. In the case of a cooling water velocity of 50 to 70 m/s, a cooling water output temperature of 81° to 82° C. will be obtained. In comparison with a cooling water temperature which is normally maintained at room temperature, such a cooling water temperature will reduce the thermal driving potential on the basis of the temperature difference between the surface temperature of the electrode and the original cooling water temperature only to an insignificant extent, i.e. sufficient cooling of the electrodes can also be achieved by hot water. At the same time, however, the condensation of steam of the steam plasma atmosphere at the electrodes, which are cooled to a more limited extent in accordance with the pesent invention, will be reduced to a small extent which can be accepted in the case of many plasma chemical processes. This advantageous effect is achieved without any increase in the expenditure of apparatuses or process technology. On the contrary, the amount of cooling measures and cooling devices required for the plasmatrons is reduced. Simultaneously, the efficiency of the respective plasmatron will be increased due to its continuous operation in the course of which little fluctuations occur as well as due to the reduction of the cooling capacity required. At the same time, product quality will be improved and the yield of the process will be increased. A special advantage is to be seen in the lengthening of electrode service life caused by the drastic reduction or rather elimination of electrode erosion by means of which electrode material is saved and the degree of disposability of the plants is substantially increased.

In accordance with a second preferred embodiment of the present invention in the form of the use of plasmatrons, which are cooled in accordance with the invention by hot water having a temperature of preferably at least 80° C., for the purpose of annihilating toxic waste products by chemical conversion, the fluctuations in the mode of operation of the plasmatron, which may possibly still occur in spite of the reduction of electrode cooling due to the use of hot-water cooling, are not acceptable, since they may still cause, though to a minor extent, an emission of toxic pollutants.

It follows that, especially for these cases of use, it is preferred to use the cooling according to the present invention, which makes use of hot water for cooling the plasmatron parts, especially the electrodes, subjected to particularly high thermal loads, in combination with a reduction of the condensation temperature of the steam plasma gas. The condensation temperature can be reduced by admixing to the steam a foreign gas having a condensation temperature which is lower than that of steam. Hence, e.g. 62.5 $m^3/h$ of air are preferably mixed with the plasma steam after the evaporation stage in the present case. The condensation temperature of the steam plasma partial component now lies at 80° C. In view of the fact that the electrode temperature obtained by electrode cooling according to the present invention is, at least in this case, preferably slightly higher than 80° C. a condensation of steam can completely be prevented in this way so that the cause of the fluctuations in the mode of operation of the plasmatron is completely eliminated and so that it is guaranteed that the conversion processes take place continuously. In this way, a breakthrough of toxic substances can completely be avoided by a steam plasmatron.

The present invention provides a plasmatron as well as a process for stable operation of a plasmatron with steam as a plasma gas in the case of which the fluctuations which are typical of steam plasmas, viz. abrupt fluctuations of the operating conditions, as well as increased electrode erosion are avoided. This is achieved by a limitation of the cooling of the plasmatron parts subjected to high thermal loads, especially the electrodes, on the basis of a use of hot water as a coolant, said hot water being used at a temperature of preferably at least 80° C. This will have the effect that a condensation of steam—which, under the influence of the arc and due to explosive evaporation of the condensate, would cause major disturbances or interruptions of the plasma jet and which would result in electrode erosion by tearing material out of the electrode surface— at intensively cooled points of the plasmatron is avoided. The present invention does not only provide stable operation and long electrode service lives, but it also improves the efficiency of the plasmatron as well as the yield of the plasma-chemical processes. For specific plasma-chemical processes, in particular for the treatment of toxic waste products, the effect of hot-water cooling of the plasmatron electrodes can additionally be increased by lowering the condensation point of the steam plasma atmosphere by admixing to the steam a gas having a condensation temperature which is lower than the condensation temperature of steam so that the the plasma gas mixture condensation temperature corresponding to the then existing steam partial pressure is lower than the temperature which is maintained as a surface temperature even at the most intensively cooled points of the plasmatron, viz. the electrodes, so that condensation phenomena and condensate evaporation phenomena resulting therefrom are actually avoided in the arc area of the plasmatron.

Although a particularly advantageous solution of the problems underlying the present invention was obtained with the aid of cooling water as a coolant, which is used at a temperature of at least 80° C. for the purpose of cooling, and although a particularly complete solution of the condensation problem can be achieved by additionally admixing air to the steam for forming the plasma gas atmosphere so as to lower the condensation temperature of the steam plasma gas, the present invention is not limited to these solutions. On the contrary, deviations and modifications can be made with due regard to the heat dissipation capacity of the cooling medium, the pressure conditions in the plasma reactor as well as the respective phase transition points, said deviations and modifications being made with the aim of avoiding the problems, which arise in the case of plasmatrons containing essentially steam as a plasma gas and which result from the condensation of steam at cooled parts of the plasmatron, said problems being avoided by choosing the cooling and/or condensation conditions in such a way that condensation of the plasma gas or of the gas mixture or of parts thereof at the cooled areas, especially the electrodes, of the plasmatron is reliably prevented.

We claim:

1. A process for stable operation of a plasmatron for annihilating toxic waste products including chlorinated or fluorinated hydrocarbons whereby said products are chemically converted in a steam plasma gas atmosphere, wherein the improvement comprises cooling electrodes of the plasmatron which are subject to high thermal loads by a plasma generating arc by forcibly flowing water coolant having a temperature of at least approximately 80° C. through said electrodes to maintain a surface temperature of said electrodes which is higher than a condensation temperature of the steam plasma gas atmosphere, said surface temperature being determined by the entry temperature of said water coolant.

2. A process according to claim 1, wherein a flow velocity of said water coolant flowing through the electrodes is 50 meters per second to 70 meters per second.

3. A process according to claim 1, wherein the condensation temperature of the steam plasma gas atmosphere is reduced by admixing with said steam plasma gas a foreign gas having a lower condensation temperature.

4. A process according to claim 3, wherein said foreign gas is air which is admixed into the steam plasma gas atmosphere after a water evaporation stage of the process.

5. A process according to claim 1, wherein the entry temperature of said water coolant is about 80° C., wherein said water coolant is forcibly circulated through the electrodes at a velocity of 50 meters per second to 70 meters per second, and wherein a an exit temperature of said water coolant is 81° C. to 82° C.

6. A process according to claim 1, wherein steam for forming a plasma gas atmosphere is supplied to the plasmatron at a temperature of 300° C. at 0.1 mpa.

7. A process for stable operation of a plasmatron for annihilating toxic waste products including chlorinated or fluorinated hydrocarbons whereby said products are chemically converted in a steam/air plasma gas atmosphere, wherein the improvement comprises cooling electrodes which are thermally acted upon by an arc to produce a plasma by forcibly flowing water coolant having a temperature of at least about 80° C. and a velocity of 50 meters per second to 70 meters per second through said electrodes to maintain a surface temperature of said electrodes which is higher than a condensation temperature of the steam/air plasma gas mixture, wherein said surface temperature is determined by an entry temperature of said water coolant of 80° C., wherein an exit temperature of said water coolant flowing out from said electrodes is 81° C. to 82° C., and wherein the condensation temperature of the steam/air plasma gas mixture is below the surface temperature of the electrodes.

* * * * *